US005297351A

United States Patent [19]

Côté

[11] Patent Number: 5,297,351

[45] Date of Patent: Mar. 29, 1994

[54] BLADES FOR SNOW-REMOVAL VEHICLES AND VEHICLES THEREWITH

[76] Inventor: Mario Côté, 422 rue Gilbert St-Léon, Lac St-Jean Qc G0W 2S0, Canada

[21] Appl. No.: 960,828

[22] Filed: Oct. 14, 1992

[51] Int. Cl.[5] ..... E01H 5/04

[52] U.S. Cl. ..... 37/232; 37/241; 37/264; 37/409

[58] Field of Search ..... 37/232, 233, 241, 264, 37/281, 270, DIG. 12, DIG. 3, 141 R, 117.5, 407, 408, 409, 410, 444, 445, 447

[56] References Cited

U.S. PATENT DOCUMENTS

| | | | |
|---|---|---|---|
| 1,957,103 | 5/1934 | Frink | 37/232 |
| 3,975,844 | 8/1976 | Olson | 37/141 R X |
| 4,077,139 | 3/1978 | Fagervold et al. | 37/241 X |
| 4,275,514 | 6/1981 | Maura | 37/281 |
| 4,707,936 | 11/1987 | Steinhoff | 37/264 |
| 4,723,609 | 2/1988 | Curtis | 37/117.5 X |
| 5,129,169 | 7/1992 | Aubichon | 37/DIG. 12 X |

*Primary Examiner*—Randolph A. Reese
*Assistant Examiner*—J. Russell McBee
*Attorney, Agent, or Firm*—Antoine H. Gauvin

[57] ABSTRACT

Blades are used in association with snow buckets articulated from snow-removing vehicles. In a preferred embodiment, the snow bucket comprises rotatably mounted about its lateral sides, a floating snow blade outwardly projectable substantially horizontally in front of the lower portion of each of the side walls of the bucket, as to float according to the conformation thereunder and to confine and to force the snow between the snow blades and the bucket to enter the bucket and to shovel it and thereby increasing the snow content of a bucket per stroke. Preferably, the floating snow blades are outwardly projectable substantially horizontally in alternation, in front of or in the back of, the lower portion of each of said side walls.

20 Claims, 2 Drawing Sheets

BLADES FOR SNOW-REMOVAL VEHICLES AND VEHICLES THEREWITH

BACKGROUND OF THE INVENTION

1. Field of the invention

This invention relates to blades for snow-removal vehicles and vehicles therewith. This invention is particularly directed to blades to be used in association with snow buckets articulated from snow-removing vehicles to enable larger charges of snow per stroke and reduce the filling time of buckets.

2. Description of related art

Normally the snow-removal vehicles that are known, are provided with a bucket articulated by a hydraulically-operated lifting arm. Several back and fore strokes are required to fill in the bucket as the snow is tending to move away from the bucket. The prior art offers no solution to reduce the amount of strokes required. These strokes are time consuming though they are required to remove the spilling of snow. No solution is taught in the prior art.

Brownly teaches, in U.S. Pat. No. 4,208,812 dated Jun. 24, 1980, a hydraulically-actuated snow plow attachment swingable in a vertical plane to inhibit the lateral flow from a snow plow blade having no lateral walls or sides.

Klett teaches, in U.S. Pat. No. 4,010,561 dated May 8, 1977, a earth-moving scraper with a pivotally adjustable router bit to fracture the soil ahead of both sides of the cutting edges of the scraper.

Arnold teaches in U.S. Pat. No. 3,854,608 dated Dec. 17, 1974, a backhoe bucket having two sections. Another backhoe bucket is disclosed in Clark, in U.S. Pat. No. 3,724,899 dated Apr. 3, 1973.

Majkrzak teaches, in U.S. Pat. No. 4,986,012 dated Jan. 22, 1991, a motorized rotary blade snowblower. The snow blower has a housing which covers the rotary blades and a drift cutting arm that is fastened to and upwardly extends from the sides of the housing in a working position.

W.W. Wolfe et al, teach, in U.S. Pat. No. 3,034,237 dated May 15, 1962, multi-function attachments, one of which is a removable scoop as shown in FIG. 6 of said Patent.

Magee et al, teach in U.S. Pat. No. 2,763,944 dated Sept. 25, 1956, bulldozer blades slidably mounted in front of a bulldozer blade.

Steinhoff teaches, in U.S. Pat. No. 4,707,936 dated Nov. 24, 1987, an attachment comprising a side plate to a snow blade.

Schneider teaches, in U.S. Pat. No. 3,373,515 dated Mar. 19, 1968, a side plate to the blader of a grader.

Martel et al, teach in Canadian Pat. No. 944,950 dated Apr. 9, 1974, an attachment for support from a rear mounted grader blade, whereby manure may be mounted.

As far as applicant is aware there is no existing blade for snow-removal vehicles. By "snow-removal vehicles" or "snow-removal vehicle" throughout the specification including the disclosure and claims, is meant those not merely pushing the snow but removing it by shovelling it with snow buckets articulated from snow-removing vehicles.

SUMMARY OF THE INVENTION

Broadly stated the invention is directed to blades for snow-removal vehicles and vehicles therewith to enable larger charges of snow per stroke and reduce the filling time of buckets.

This ingenious device is simple to produce, easy to mount onto snow-removal vehicles and is relatively inexpensive with respect to the advantages to be derived therefrom.

In a preferred embodiment, this invention relates to a snow bucket comprising rotatably mounted about its lateral sides, a floating snow blade outwardly projectable frontward in front of the lower portion of each of said side walls, as to float according to the conformation or configuration thereunder, of the surface bearing said snow blade and to confine and to force the snow between said snow blades and said bucket to enter said bucket and to shovel it and thereby increasing the snow content of a bucket per stroke.

In another preferred embodiment the invention is directed to a snow bucket comprising side walls, bottom and rear walls joining said side walls to define a bucket, rotatably mounted about each of said side walls, a snow blade outwardly projecting frontward from the lower portion of each of said side walls as to float according to the conformation or configuration thereunder, of the surface bearing said snow blade and to confine and to force the snow between said snow blades and said bucket to enter said bucket and to shovel it and thereby increasing the snow content of a bucket per stroke.

In another preferred embodiment the snow bucket comprises: side walls, bottom and rear walls joining said side walls to define a bucket, rotatably mounted about each of said side walls, a floating snow blade outwardly projectable in alternation, in front of or in the back of, the lower portion of each of said side walls as to float according to the conformation or configuration thereunder, of the surface bearing said snow blades and when said floating snow blades are outwardly projecting in front of the lower portion of each of said side walls to confine and to force the snow between said snow blades and said bucket, and said snow to enter said bucket, and to shovel it and thereby increasing the snow content of a bucket per stroke, and when said floating snow blades are outwardly projectable in the back of the lower portion of each of said side walls to confine and to force the snow between said snow blades and the back of said bucket, and thereby avoiding said snow to produce heaps, embankments or monticules on each side of a bucket during charging and pushing operations.

The invention is also directed to a snow-removal wheeled vehicle having a bucket and lifting arms including pistons coupled with hydraulic means to hydraulically articulate and join said bucket to said snow-removal wheeled vehicle, said bucket having side walls, bottom and rear walls joining said side walls to define a bucket, rotatably mounted about each of said side walls, a floating snow blade outwardly projectable in alternation, in front of and in the back of, the lower portion of each of said side walls as to float according to the conformation or configuration thereunder, of the surface bearing said snow blade and when said floating snow blades are outwardly projecting in front of the lower portion of each of said side walls to confine and to force the snow between said snow blades and said bucket, and said snow to enter said bucket, and to shovel it and thereby increasing the snow content of a bucket per stroke, and when said floating snow blades are outwardly projectable in the back of the lower portion of each of said side walls to confine and to force the snow between said snow blades and the back of said bucket, and thereby avoiding said snow to produce heaps, embankments or monticules on each side of a bucket during charging and pushing operations.

BRIEF DESCRIPTION OF THE DRAWINGS

Referring now to the drawings which illustrate a preferred embodiment of the invention.

DETAILED DESCRIPTION

Figure 1:
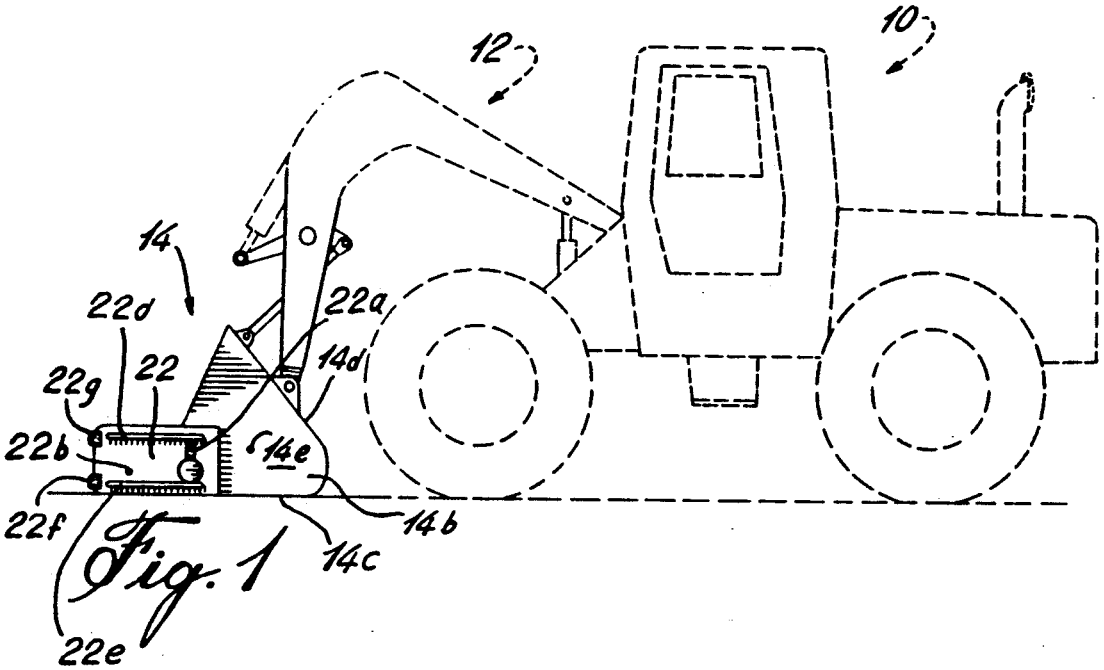
FIG. 1 is a schematic side view of a snow-removal vehicle acting frontward.
Figure 2:
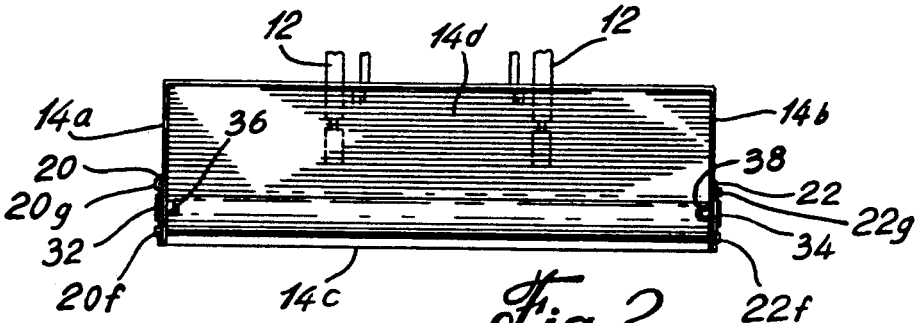
FIG. 2 is a face view of the bucket of FIG. 1.
Figure 3:
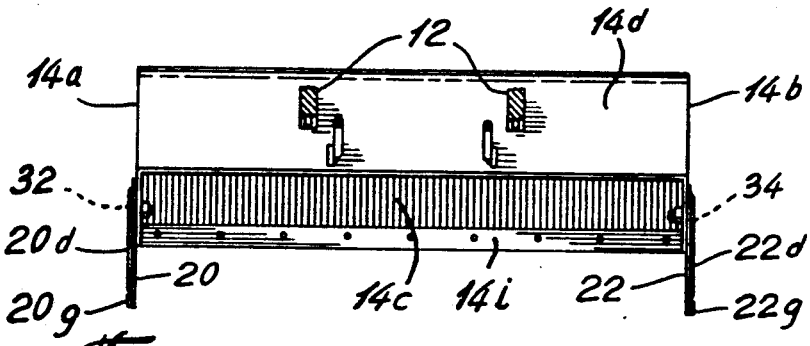
FIG. 3 is a top view of the bucket of FIG. 1.

Referring to FIGS. 1, 2 and 3, and particularly 1, a snow-removal wheeled vehicle 10 having lifting arm or arms 12 including pistons coupled with hydraulic means to hydraulically articulate a bucket 14.

The bucket 14 comprises side walls 14*a*, 14*b*, bottom and rear walls, respectively 14*c* and 14*d*, joining said side walls to define a bucket and may include a bolted or riveted scrapper blade 14*i*, FIG. 3.

A floating snow blade, respectively 20, 22, is rotatably mounted about each of said side walls 14*a*, 14*b*, to be outwardly projecting in front of the lower portion of each of said side walls, as to float according to the conformation thereunder. The floating snow blades are outwardly projecting from the lower portion of one of the side walls to confine and force the snow between said snow blades and said bucket to enter said bucket and to shovel it and thereby increasing the snow content of a bucket per stroke, that is per time the bucket is filled and emptied.

The snow blades are preferably plates having parallelogram shape and are most preferably rectangularly shaped.

In a particular embodiment, when snow blades are rectangularly shaped plates having a pair of opposite long sides and of opposite short sides, each of said plates near one of its short sides, about mid-way of said one short side, are rotatably mounted about the lower portion of each of said side walls of said snow bucket.

If desired, each of said plates near the edge of each of their long sides, has a reinforcing rib or a reinforcing bar running parallel to each of said long sides, such as 20*d*, 20*e*, 22*d* and 22*e*. Also at least one of said short sides, the one farthest away from the axis of rotation of the plates, may be provided with resilient corners 20*f*, 20*g*, 22*f*, 22*g*, for to act as rubber-like resilience bumpers instance rubber.

In a preferred embodiment, the plates have also rounded corners.

In a preferred embodiment, each of said plates near one of its short sides, is pivotally or rotatably mounted about said side walls near said bottom wall of said snow bucket and away from said rear wall of said bucket.

There are numerous ways for the floating snow blades to be rotatably mounted. One of the simplest and preferred ways is to use a pin,(such as 32, 34 FIG.3) cooperating with a retaining disc, for instance a steel disc,(such as 36 and 38 FIG. 2), and to provide elongated slots on floating snow blades 20, 22 parallel to the short sides of the blades (of various shapes, as examples arcuated at 22*a* FIG. 5 or not 22*a*), and correspondingly an orifice on each of the side walls 14*a*, 14*b*, thereby each of the pins snugly fitting one of the orifices and one of said slot in one of said snow blades and enabling sliding and floating of said snow blades. The stem of pins 32, 34, near their respective free end, may be provided with a channel to receive a lock pin therethrough and thereby prevent sliding of said retaining "disc" which is meant to include sleeve throughout the disclosure and claims. The head of pins 32, 34 must be of a thickness less than that of the reinforcing ribs 20*d*, 20*e*, 22*d*, 22*e*, to be in recess therefrom to avoid their damaging during snow removal. Instead of lock pins a steel plate may be fastened to the free end of the stem of the pins with a bolt or screw, the stem having suitable axial thread.

Figure 5:
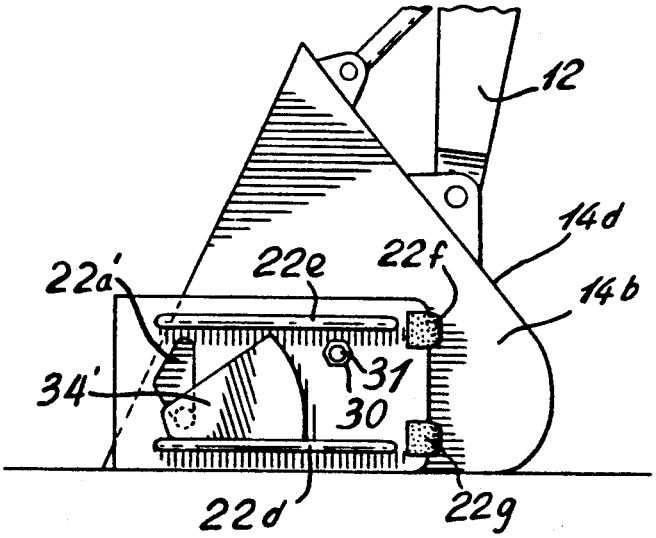
FIG. 5 is a side view of the bucket with the floating snow blades in the lock position.

In a preferred embodiment, the head of the pins 32', 34' is a metallic plate having a shape to engage the side of the reinforcing ribs 20*d*, 20*e*, 22*d*, 22*e*, to allow simultaneous rotation of the blade with the pin and thereby reduce wearing of the pin under the blade, as shown in FIG. 5. However, the shape of the heads must be such as to not interfere with the floating of the blades. Discs or sleeves 36, 38 are preferably fastened to the side walls 14*a*, 14*b*. Welding is one of the convenient ways. They may also be provided with lubricating channels. Instead of pins, bolts and locking nuts may be used if desired. Bearings may be used if desired, Teflon TM bearing type being TM a trade mark preferred. Though less preferred, inversely the slot could be on each of the side walls 14*a*, 14*b* and an orifice on floating snow blades 22, 24.

In order to be able to operate said bucket for other purposes, it is convenient to provide the snow blades with means to releasably hold each of said plates against their respective adjacent side walls of said bucket. For instance the blades may be pivoted against their respective side walls, the side walls and the snow blades being provided with corresponding orifices such as 14*e* and 22*b* (FIGS. 4 and 5) to receive a peg or pin and lockpin or bolt and nut, or one of the member selected from said side walls and the snow blades may have a threaded orifice to receive a bolt. Other fastening means may be used as desired.

OPERATION

Figure 4:
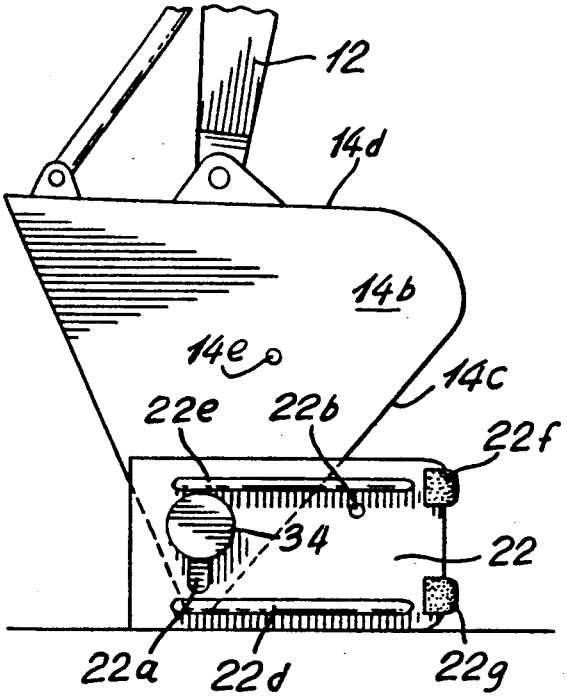
FIG. 4 is a side view of the bucket and the floating snow blades acting backwardly.

FIG. 1 illustrates the snow-removal wheeled vehicle 10 having lifting arm or arms 12 including pistons in position to move frontward the bucket and the floating snow blades. One of the advantages of the applicant's invention, as shown in FIG. 4, enables quick rotation of the floating snow blades and its positioning backwardly to backwardly push and confine and cumulate snow between the floating snow blades and the bottom wall, 14*c*.

As shown in FIG. 5, the floating snow blades may be fastened against the side walls of the bucket 14 with peg or bolt 30 and nut and lockwasher 31 or other fastening means and thereby the snow-removal may be used for other purposes without hindering, hampering or obstruction by said floating snow blades.

As can be easily seen, this invention is directed in general to any snow-removal vehicle having a bucket able to collect snow.

The dimensions of the floating snow blades are function of the size of the bucket to increase the snow pick up of a bucket thereby decreasing the embankment or monticule on each side of a bucket during charging operations.

EXAMPLES

In a particular embodiment snow blades are rectangularly shaped steel plates. The height of said blades is about half that of the height of said side walls and the length is about that of the length of the side walls but stopping short thereof. The time to remove the snow was thereby reduced from 25% to 40%.

Though less preferred, some benefits may also be derived using only one floating blade. The floating blades may be sold as such, attached to buckets or already mounted on a snow-removal vehicle.

While this invention has been described in conjunction with a preferred embodiment thereof, It is clear and obvious from the above description that numerous modifications and changes therein may be made by those skilled in the art without departing from the spirit and scope of this invention as defined by the claims appended hereto.

I claim:

1. A snow bucket comprising;

side walls, bottom and rear walls joining said side walls to define a bucket having an opening away from said rear wall, at least one floating snow blade having opposite top and bottom edges, said top and bottom edges being substantially straight and having each respectively opposite ends, said at least one blade near one of the ends between said top and bottom edges, being rotatably mounted to one of said side walls and substantially parallel to said one of said side walls, adjacent to said bottom and near said opening of said bucket, with a means to rotate joining said blade to said one of said side walls and said means to rotate being the only means to hold said blade to said bucket, to enable said blade to be floating according to configuration of the surface bearing said bottom edge, underneath said bottom edge, and for allowing said snow blade to be projectable frontward, in front of the lower portion of said at least one of said side walls, adjacent to said opening, to confine and to force any snow adjacent to said snow blade and said opening of said bucket to enter said bucket, to be shovelled, and thereby to increase the snow content of a bucket per stroke.

2. The snow bucket as defined in claim 1, having a pair of said at least one floating snow blades, each blade having opposite top and bottom edges, said top and bottom edges being substantially straight and having each respectively opposite ends, each one of the blades near one of the ends between said top and bottom edges, being each respectively rotatably mounted to one of said side walls and substantially parallel to said side walls, adjacent to said bottom and near said opening of said bucket, with each respectively a means to rotate joining one of said blades to one of said side walls and said means to rotate being the only means to hold said blades to said bucket, to enable said blades, each respectively, to be independently floating according to configuration of the surface bearing said bottom edge of said blades, underneath said bottom edge, and for allowing said blades, each independently, to be projected frontward in front of the lower portion of each of said side walls, to confine and to force any snow between said snow blades and said opening of said bucket to enter said bucket, to be shovelled, and thereby to increase the snow content of a bucket per stroke.

3. A snow bucket comprising:

side walls, bottom and rear walls joining said side walls to define a bucket having an opening away from said rear wall, said opening being the front of said bucket, a pair of floating snow blades, each blade having opposite top and bottom edges, said top and bottom edges being substantially straight and having each respectively opposite ends, each one of the blades near one of the ends between said top and bottom edges, being each independently rotatably mounted to one of said side walls and substantially parallel to said one of said side walls, adjacent to said bottom and near said opening of said bucket, with a means to rotate joining one of said blades to one of said side walls and said means to rotate being the only means to hold said blades to said bucket, to enable said blades, each respectively to be independently floating according to configuration of the surface bearing the bottom edge of each of said blades, underneath their respective bottom edge and for allowing said blades, each independently, to be alternately projectable upon their rotation, frontward of the lower portion of each of said side walls adjacent to said opening, in order to confine and to force any snow between said snow blades and said bucket, and said snow to enter said bucket, to be shovelled and thereby to increase the snow content of a bucket per stroke, and backwardly, from the bottom wall of said bucket, to confine and to force the snow between said snow blades and the back of said bucket, and thereby to prevent said snow from producing heaps and embankments on each side of a bucket during charging and pushing operations.

4. The snow bucket as defined in claim 3, wherein said snow blades are plates having parallelogram shape.

5. The snow bucket as defined in claim 3, wherein said snow blades are rectangularly shaped.

6. The snow bucket as defined in claim 3, wherein said snow blades are rectangularly shaped plates having a pair of opposite long sides, defining said opposite top and bottom edges, and a pair of opposite short sides, each of said plates near one of its short sides, about mid-way of said one short side, being rotatably mounted to the lower portion of each of said side walls of said snow bucket.

7. The snow bucket as defined in claim 1, wherein said snow blade is a rectangularly shaped plate having a pair of opposite long sides, defining said opposite top and bottom edges and a pair of opposite short sides, said plate near one of its short sides, about mid-way of said one short side, being rotatably mounted to said at least one of said side walls.

8. The snow bucket as defined in claim 3, wherein at least one orifice is provided in each of said snow blades and correspondingly an orifice in their corresponding side walls, and each of said snow blades includes a fastening means through their corresponding orifices to releasably hold each of said plates against their respective adjacent side walls of said bucket.

9. The snow bucket as defined in claim 3, wherein said snow blades are rectangularly shaped and wherein the height of said blades is about half that of the height of said side walls and the length is approaching that of the length of the side walls but stopping short thereof.

10. The snow bucket as defined in claim 3, wherein said snow blades are rectangularly shaped plates having a pair of opposite long sides, defining said opposite top and bottom edges, and of opposite short sides, each of said plates near the edge of each of their long sides, having a reinforcing rib running parallel to each of said long sides.

11. The snow bucket as defined in claim 10, wherein said rib is a strengthening bar.

12. The snow bucket as defined in claim 3, wherein said snow blades are rectangularly shaped plates having a pair of opposite long sides, defining said opposite top and bottom edges and a pair of opposite short sides, each of said plates near one of its short sides, being rotatably mounted to said side walls, each of said plates near the edge of each of their long sides, having a reinforcing rib running parallel to each of said long sides and at least one of said short sides having rubber-like resilience bumpers.

13. The snow bucket as defined in claim 12, wherein only the other of said short sides has said resilient bumpers.

14. The snow bucket as defined in claim 3, being articulated on a snow-removal wheeled vehicle.

15. The snow bucket as defined in claim 3, being hydraulically articulated on a snow-removal wheeled vehicle.

16. A snow bucket comprising;

side walls, bottom and rear walls joining said side walls to define a bucket having an opening away from said rear walls, a pair of floating snow blades, said snow blades being rectangularly shaped plates having a pair of opposite long sides, defining opposite tope and bottom edges, and of opposite short sides, each of said plates near one of its short sides, having an elongated slot running parallel to said short sides, and correspondingly an orifice on the side wall of said bucket adjacent each of said plates, each of said orifices having a headed pin snugly fitting one of said orifices and the slot in the adjacent plate in order to enable sliding and floating and floating of said snow blade, and cooperating with each of said headed pins a retaining disc sandwiching one of said side walls and one of said plates together in between a pin and a disc, and thereby while being rotably mounted to and solely held to one of said side walls with one of said headed pins so as to float according to configuration of the surface bearing said bottom edge, underneath said bottom edge, allowing said blades, each independently, upon their rotation to be alternately projected:

frontward of the lower portion of each of said side walls adjacent to said opening, in order to confine and to force any snow between said snow blades and said bucket, and said snow to enter said opening of said bucket to be shovelled and thereby to increase the snow content of a bucket per stroke, and backwardly, from the bottom wall, of said bucket, to confine and to force the snow between said snow blades and the back of said bucket, and thereby to prevent said snow from producing heaps and embankments on each side of a bucket during charging and pushing operations.

17. A snow-removal wheeled vehicle having a bucket and lifting arms including pistons coupled with hydraulic means to hydraulically articulate and join said bucket to said snow-removal wheeled vehicle, said bucket having side walls, bottom and rear walls joining said side walls to define a bucket having an opening away from said rear wall, a pair of floating snow blades, each blade having two opposite long sides defining a top and a bottom edge, said sides being substantially straight and having each respectively opposite ends, each one of the blades near one of the ends between said top and bottom edges, being each independently rotatably mounted to one of said side walls and substantially parallel to said side walls, adjacent to said bottom and near said opening of said bucket, with a means to rotate joining said blade to said one of said side walls and said means to rotate being the only means to hold said blade to said bucket, to enable said blade to a floating according to configuration of the surface bearing said bottom edge, underneath said bottom edge and for allowing said blades, each independently, to be alternately projected upon their rotation, frontward of the lower portion of each of said side walls adjacent to said opening, in order to confine and to force the snow between said snow blades and said bucket, and said snow to enter said bucket, and to shovel it and thereby to increase the snow content of a bucket per stroke, and backwardly, from the bottom wall, of said bucket, to confine and to force the snow between said snow blades and the back of said bucket, upon pushing snow with a portion of said bottom wall adjacent to said blades, and thereby to prevent said snow from producing heaps and embankments on each side of a bucket during charging and pushing operations.

18. A snow-removal wheeled vehicle having a bucket and lifting arms including pistons coupled with hydraulic means to hydraulically articulate and join said bucket to said snow-removal wheeled vehicle, said bucket having side walls, bottom and rear walls joining said side walls to define a bucket having an opening away from said rear wall, a pair of floating snow blades, said snow blades being rectangularly shaped plates and having a pair of opposite long sides and of opposite short sides, each of said plates near one of its short sides, having an elongated slot running parallel to said short sides, and correspondingly an orifice on the side wall of said bucket adjacent to each of said plate, each of said orifices having a headed pin snugly fitting into one of said orifices and the slot in the adjacent plate to enable sliding and floating of said snow blade, and cooperating with each of said headed pins a retaining disc to sandwich one of said side walls and of said plates, in between a pin and a disc, to enable said blade to be floating and alternately projectable frontward and backwardly.

19. A snow-removal wheeled vehicle as defined in claim 17, wherein said floating snow blades include at least one orifice in each of said plates and correspondingly an orifice in their corresponding snow blade, and each of said snow blades includes a fastening means through their corresponding orifices to releasably hold each of said plates against their respective adjacent side walls of said bucket.

20. The snow bucket as defined in claim 16, wherein said plates are steel plates.

* * * * *